US006763216B2

(12) United States Patent
Ishibashi et al.

(10) Patent No.: US 6,763,216 B2
(45) Date of Patent: Jul. 13, 2004

(54) DEVELOPING DEVICE AND IMAGE FORMING APPARATUS INCLUDING THE SAME

(75) Inventors: Mikio Ishibashi, Yokohama (JP); Shuji Tanaka, Chigasaki (JP)

(73) Assignee: Ricoh Company, Ltd., Tokyo (JP)

( * ) Notice: Subject to any disclaimer, the term of this patent is extended or adjusted under 35 U.S.C. 154(b) by 92 days.

(21) Appl. No.: 10/156,853

(22) Filed: May 30, 2002

(65) Prior Publication Data

US 2002/0197086 A1 Dec. 26, 2002

(30) Foreign Application Priority Data

| | | |
|---|---|---|
| May 31, 2001 | (JP) | 2001-164950 |
| Aug. 20, 2001 | (JP) | 2001-249020 |
| May 2, 2002 | (JP) | 2002-130826 |
| May 24, 2002 | (JP) | 2002-151009 |

(51) Int. Cl.[7] ..... G03G 15/09
(52) U.S. Cl. ..... 399/272; 399/274
(58) Field of Search ..... 399/107, 111, 399/119, 252, 265, 267, 272, 274, 275, 276

(56) References Cited

U.S. PATENT DOCUMENTS 5,206,690 A * 4/1993 Shimizu et al. ..... 399/272

FOREIGN PATENT DOCUMENTS

| | | |
|---|---|---|
| JP | 5-72886 | 3/1993 |
| JP | 11-327289 | 11/1999 |

OTHER PUBLICATIONS

U.S. patent application Ser. No. 10/156853, Ishibashi et al., filed May 30, 2002.

U.S. patent application Ser. No. 10/447,949, Mizuishi, filed May 30, 2003.

* cited by examiner

*Primary Examiner*—Hoang Ngo
(74) *Attorney, Agent, or Firm*—Oblon, Spivak, McClelland, Maier & Neustadt, P.C.

(57) ABSTRACT

A developing device for feeding a developer stored therein to an image carrier of the present invention includes a sleeve facing the image carrier for causing the developer deposited thereon to contact a latent image formed on the image carrier. A regulating member faces the sleeve for regulating the thickness of the developer that forms a layer on the sleeve. A guide member has a guide surface for guiding the developer regulated by the regulating member toward the surface of the image carrier. The guide surface has a conductive surface facing the sleeve. The developing device protects the image carrier from defective images ascribable to impurities, which include deteriorated toner and paper dust, without resorting to a filter mechanism or a bias for collection.

25 Claims, 6 Drawing Sheets

FIG. 6

| | PRIOR ART | EMBODIMENT |
|---|---|---|
| MEAN FREQUENCY OF DEFECTS (SHEETS/500 SHEETS) | 15 | 3 |
| EVALUATION | X | O |

DEVELOPING DEVICE AND IMAGE FORMING APPARATUS INCLUDING THE SAME

BACKGROUND OF THE INVENTION

1. Field of the Invention

The present invention relates to a structure for dealing with impurities contained in recycled toner and more particularly to a developing device configured to obviate defective images ascribable to the impurities and an image forming apparatus including the same.

2. Description of the Background Art

It is a common practice with a copier, facsimile apparatus, printer or similar image forming apparatus to develop a latent image formed on a photoconductive element or image carrier with toner, which is contained in a developer. Developers are generally classified into a single-component type developer, i.e., magnetic or nonmagnetic toner and a two-ingredient type developer made up of a magnetic carrier and toner deposited on the carrier. The toner contains a pigment therein. The two-ingredient type developer is deposited on a sleeve, which accommodates a magnet roller therein, in the form of a magnet brush and brought into contact with a latent image formed on the photoconductive element. When the magnet brush contacts the latent image, the toner is caused to deposit on the latent image for thereby producing a corresponding toner image.

To maintain the toner content of the developer constant, fresh toner is replenished to make up for the consumption of the toner ascribable to repeated development. However, if only fresh toner is repeatedly replenished, used toner is often simply discarded. It has recently been proposed to return residual toner removed from the photoconductive element after image transfer to the developing device, thereby recycling the toner. This not only reduces loads on environment, but also enhances yield. Such recycled toner, however, has the following problems left unsolved.

The recycled toner differs from fresh toner in that it contains impurities including paper dust derived from sheets to which toner images are transferred. Paper dust is scraped off the photoconductive element together with the toner after image transfer and then returned to the developing device together with the toner. Paper dust not only obstructs the deposition of the toner on a latent image, but also effects the charging characteristic of the toner. Further, when the paper dust enters the developing device, it often degrades the fluidity of the toner being agitated in the developing device, preventing the toner from achieving an expected charging characteristic.

Moreover, assume that the developer containing the recycled toner and paper dust together with fresh toner moves away from a doctor blade or regulating member. Then, the paper dust deposits on the background area (white portion) of the photoconductive element when the developer contacts the latent image. This results in the local omission of a toner image and defective charging, which is ascribable to the deposition on the background area. More specifically, when a charger is used, the paper dust obstructs the injection of charge into the portion where it has deposited.

Why the recycled toner and paper dust deposit on the background of the photoconductive element will be described hereinafter. The residual toner and paper dust collected from the photoconductive element are lower in charging ratio than fresh toner even when returned to and agitated in the developing device. Therefore, the electric coupling force of the residual toner and paper dust with the carrier is weak and unstable, so that such toner and paper dust leave the carrier during rotation of the sleeve due to a centrifugal force and an air stream. The recycled toner and paper dust so released from the carrier fly around the sleeve and photoconductive element or deposit on surrounding members. Consequently, the recycled toner and paper dust contaminate the background area of the photoconductive element when deposited there.

In light of the above, Japanese Patent Laid-Open Publication Nos. 10-260583 and 11-311902, for example, disclose classifying means including a mesh filter. The classifying means, however, not only makes the construction sophisticated, but also increases the cost because a measure against the stop-up of the mesh filter is necessary. Furthermore, impurities removed by the mesh filter constitute another matter that must be discarded. While a special construction using a bias for the collection of impurities may be contemplated, it also increases the cost.

Technologies relating to the present invention are also disclosed in, e.g., Japanese Patent Laid-Open Publication Nos. 5-72886 and 11-327289.

SUMMARY OF THE INVENTION

It is an object of the present invention to provide a structure for dealing with impurities contained in recycled toner.

It is another object of the present invention to provide a developing device capable of obviating defective images ascribable to impurities, which are contained in recycled toner, and an image forming apparatus including the same.

A developing device for feeding a developer stored therein to an image carrier of the present invention includes a sleeve facing the image carrier for causing the developer deposited thereon to contact a latent image formed on the image carrier. A regulating member faces the sleeve for regulating the thickness of the developer that forms a layer on the sleeve. A guide member has a guide surface for guiding the developer regulated by the regulating member toward the surface of the image carrier. The guide surface has a conductive surface facing the sleeve.

An image forming apparatus including the above developing device is also disclosed.

BRIEF DESCRIPTION OF THE DRAWINGS

The above and other objects, features and advantages of the present invention will become more apparent from the following detailed description taken with the accompanying drawings in which:

FIG. 6 shows the results of a comparison between a prior art embodiment and an illustrative embodiment of the present invention.

DESCRIPTION OF THE PREFERRED EMBODIMENTS

Figure 1:
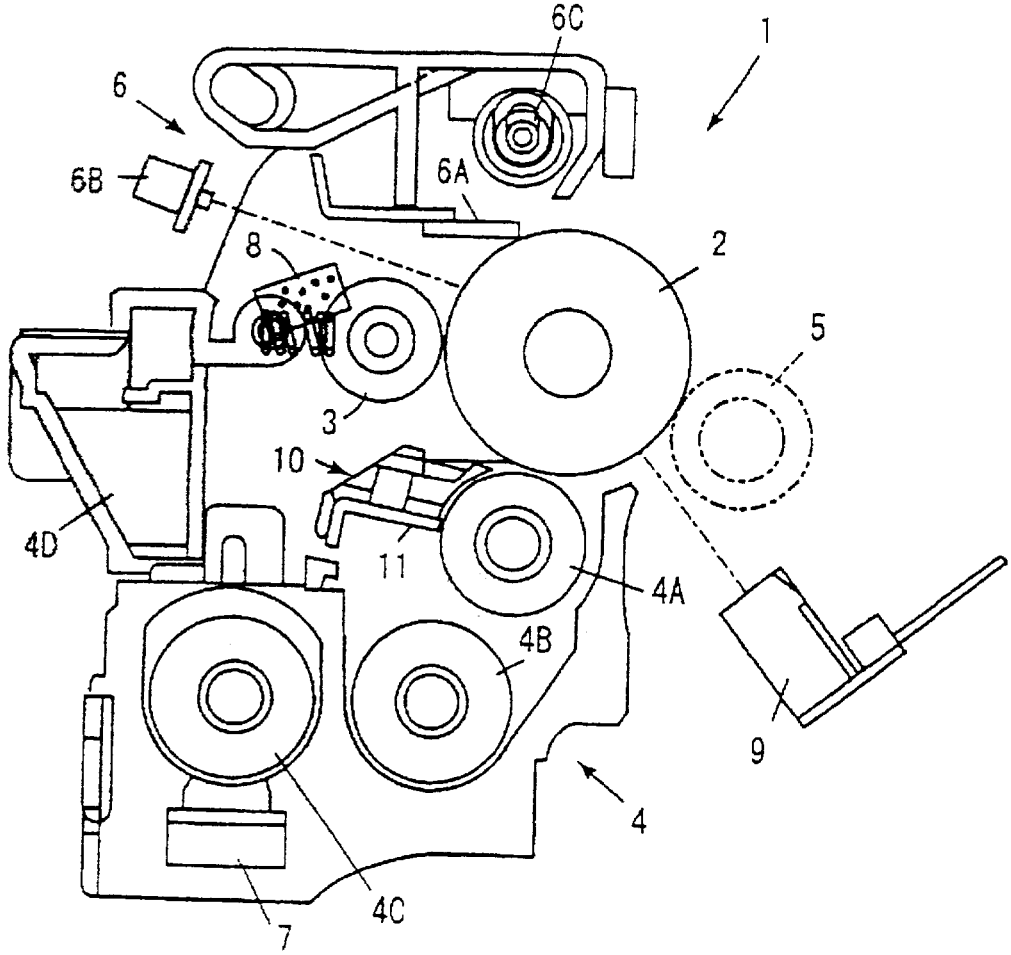
FIG. 1 is a view showing an image forming apparatus including a developing device embodying the present invention.

Referring to FIG. 1 of the drawings, an image forming apparatus to which a developing device embodying the present invention is applied is shown. As shown, the image forming apparatus, generally 1, includes an image carrier implemented as a photoconductive drum 2. The photoconductive drum (simply drum hereinafter) 2 is rotatable counterclockwise, as viewed in FIG. 1. Arranged around the drum 2 are a charger 3, an optical writing unit, not shown, a developing device 4, an image transferring device 5, and a cleaning device 6. In the illustrative embodiment, the charger 3 is implemented as a charge roller.

In operation, while the drum 2 is in rotation, the charger 3 uniformly charges the surface of the drum 2. The optical writing unit optically scans the charged surface of the drum 2 in accordance with image data to thereby form a latent image. The developing device 4 develops the latent image to thereby produce a corresponding toner image. The image transferring device 5 transfers the toner image to a sheet or recording medium. After a fixing device, not shown, has fixed the toner image on the sheet, the sheet or print is driven out to a tray not shown.

After the image transfer, the cleaning device 6 removes toner, paper dust and other impurities left on the drum 6 with a cleaning blade 6A. The cleaning device 6 then discharges the surface of the drum 2 with a discharge lamp 6B. Subsequently, the charger 3 again uniformly charges the surface of the drum 3 for thereby preparing the drum 3 for the next image formation.

A screw 6C included in the cleaning device 6 conveys the impurities removed from the drum 2 by the cleaning blade 6A to one axial end of a second screw 4C, which is included in the developing device 4. In this manner, the impurities including toner are recycled.

The developing device 4 includes a rotatable sleeve 4A and a first screw 4B in addition to the second screw 4C. The sleeve 4A accommodates a stationary magnet roller thereinside and faces the drum 2; the magnet roller has a main magnetic pole for development and magnetic poles for conveyance. The first screw 4B extends in the axial direction of the sleeve 4A for feeding a developer, i.e., a toner and carrier mixture to the sleeve 4A while agitating it. The second screw 4C also conveys the toner along the axis of the drum 2, but in the opposite direction to the first screw 4C.

A toner content sensor 7 senses the toner content of the developer existing in the developing device 4. The second screw 4C is rotated in accordance with the output of the toner content sensor 7 to replenish fresh toner from a toner tank 4D. At the same time, the second screw 4C conveys the recycled toner returned from the cleaning device 6. Further, in the developing device, the toner replenishing condition is controlled in accordance with the output of an image density sensor 9, which is positioned to face the drum 2. In FIG. 1, the reference numeral 8 designates a cleaning member for cleaning the surface of the charger or charge roller 3.

Figure 2:
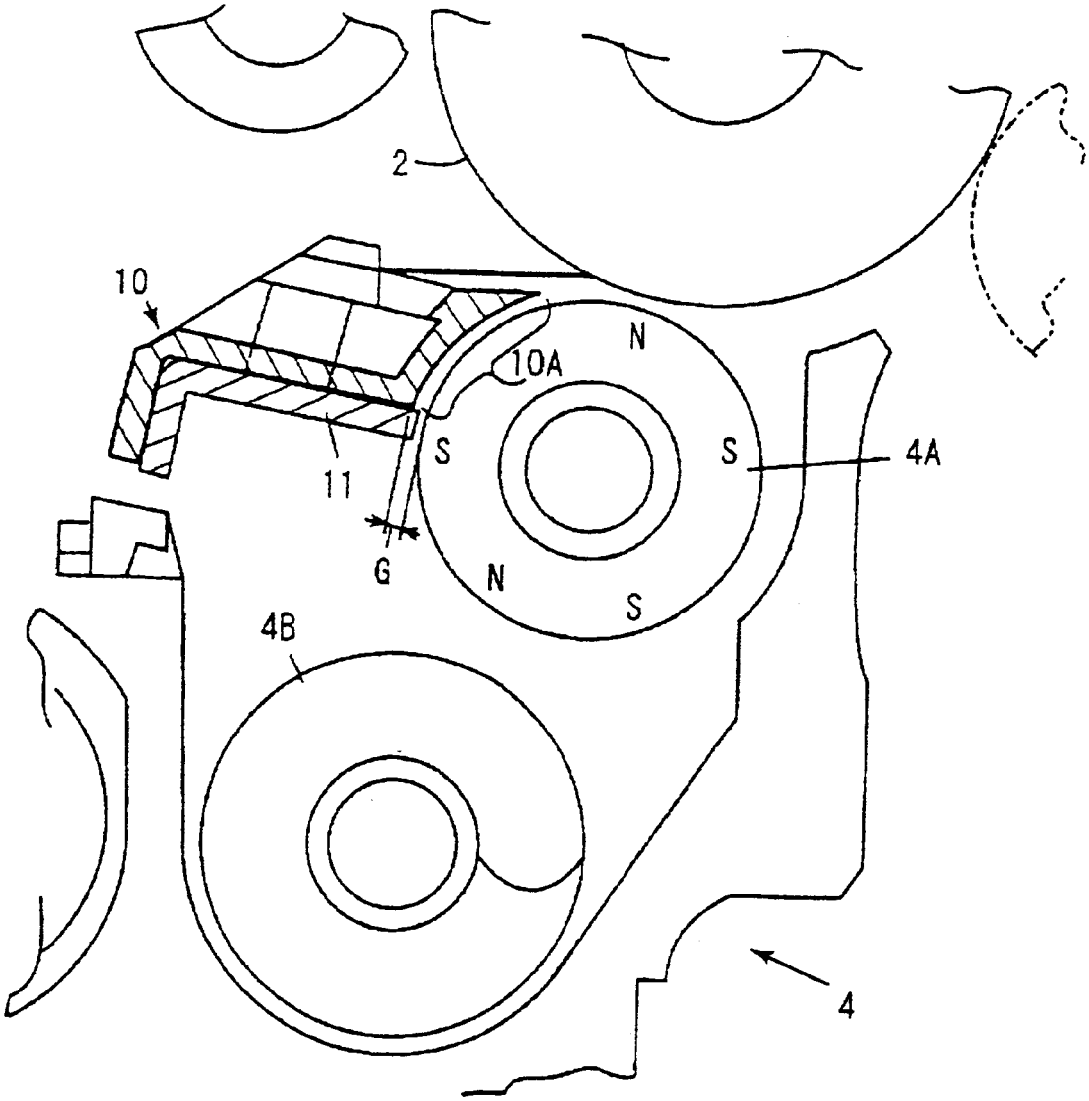
FIG. 2 is a fragmentary view showing the developing device in detail.

As shown in FIG. 2, the developer conveyed by the first screw 4B deposits on the sleeve 4A. While the sleeve 4 in rotation conveys the developer forming a magnet brush thereon, a doctor blade or regulating member 11 regulates the height of the magnet brush to preselected height. The doctor blade 11 is affixed to a guide member 10. In the illustrative embodiment, the doctor blade 11 is formed of a conductive material and held in an electrically floating state so as not to unnecessarily agitate or charge the developer contacting it.

The guide member 10 is held stationary relative to the sleeve 4A. The doctor blade 11 is affixed to the guide member 10 at the upstream side of the sleeve 4A in the direction of rotation of the sleeve 4A, i.e., on the underside of the guide member 10 as seen in FIG. 2. The guide member 10, including its guide surface 10A, is formed of a conductive material. In the illustrative embodiment, the guide member 10 is formed of iron, aluminum or similar metal or conductive resin.

More specifically, if the guide member 10 is formed of a magnetic material, then a magnetic field is formed between the guide member 10 and the sleeve 4A and causes the developer to stay there, resulting in short image density. Therefore, the guide member 10 should preferably be formed of a nonmagnetic material, e.g., stainless steel, aluminum or copper. Among them, aluminum is desirable from the cost and machining standpoint although stainless steel or copper may sometimes be desirable, depending on the configuration of the guide member 10.

The guide surface 10A of the guide member 10 guides the developer moved away from the doctor blade 11 and moving together with the sleeve 4A. For this purpose, the guide surface 10A is spaced from the surface of the sleeve 4A by a gap G and complementary in shape to the sleeve 4A.

More specifically, the gap G is sized such that the guide surface 10A guides the developer regulated in height by the doctor blade 11 toward a nip between the sleeve 4A and the drum 2 while preventing it from flying about. Stated another way, the developer moves along the guide surface 10A while contacting the entire guide surface 10A or part of the guide surface 10A or without contacting it at all. The developer has its regulated height maintained when contacting the guide surface 10A or is prevented from flying about when not contacting it.

Figure 3A:
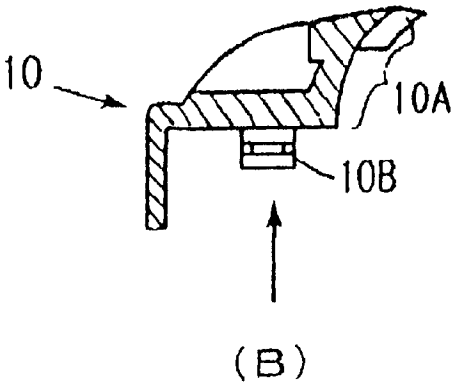
FIG. 3A is a fragmentary, sectional side elevation showing the guide surface of a guide member included in the developing device.
Figure 3B:
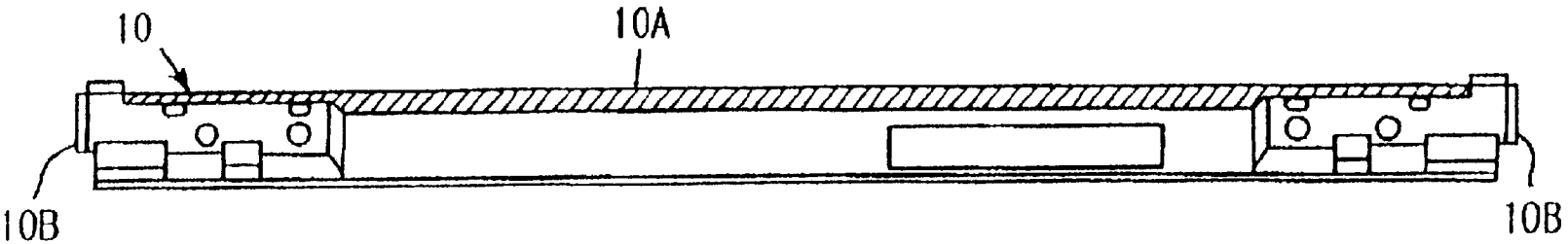
FIG. 3B is a view showing the guide surface as seen in a direction (B) of FIG. 3A.

FIGS. 3A and 3B show the configuration of the guide member 10 more specifically. The guide member 10 extends in the axial direction of the sleeve 4A together with the doctor blade 11 not shown. As shown in FIGS. 3A and 3B, the guide member 10 has engaging portions 10B at opposite ends thereof. The guide member 10 is connected to the doctor blade 11 via the engaging portions 10B and held in an electrically floating state thereby. The guide surface 10A is therefore held at the same potential as the doctor blade 11 and/or the sleeve 4A due to electrical conduction.

In the above configuration, when the developer passes through the gap G between the sleeve 4A and the guide surface 10A, the toner deteriorated in charging characteristic due to recycling and paper dust, which are contained in the developer, deposit on the guide surface 10A little. Therefore, the deteriorated toner and paper dust do not deposit on the guide surface 10A in a great amount. This will be described more specifically hereinafter.

The potential of the deteriorated toner and paper dust is lower than the potential of the toner contained in the magnet brush, which is formed on the sleeve 4A and is unstable. Therefore, if the guide surface 10A of the guide member 10 is not conductive, then the deteriorated toner and paper dust are apt to deposit on the guide surface 10A due to dielectric polarization. Further, as the toner recycling is repeated, more deteriorated toner and more paper dust pass through the gap G and deposit on the guide surface 10A. When vibration, for example, acts on the guide surface 10A in such a condition, the deteriorated toner and paper dust bodily come off the guide surface 10A and are conveyed to the nip between the drum 2 and the sleeve 4A by the sleeve 4A. Consequently, the deteriorated toner and paper dust contaminate the background area of the drum 2 and make the resulting toner image locally omitted or otherwise defective.

In the illustrative embodiment, the conductive, electrically floating guide surface 10A remains at the same potential as the doctor blade 11 and/or the sleeve 4A, as stated above. In this condition, the guide surface 10A and doctor blade 11 and the sleeve 4A play the role of electrodes facing each other via the gap G over the entire range including the doctor blade 11 and guide surface 10A. The guide surface 10A can therefore be considered to be equivalent to a capacitor in the aspect of electric circuitry. Because this capacitor has small electrostatic capacity, a potential difference occurs from the sleeve 4A toward the guide surface 10A at the initial stage of operation, i.e., when the developing device 4 is not new. However, once the deteriorated toner and paper dust corresponding to charged grains contact the guide surface 10A, they neutralize the above potential difference and thereby make the guide surface 10A identical in potential with the doctor blade 11 and/or the sleeve 4A. This condition is maintained thereafter.

Stated another way, the guide surface 10A and sleeve 4A are electrically connected to each other via the developer and brought to the same potential thereby. This cancels a force driving the deteriorated toner and paper dust toward the guide surface 10A to thereby prevent them from accumulating on the guide surface 10A.

The fact that the deteriorated toner and paper dust move toward or deposit on the guide surface 10A little does not mean that the deteriorated toner and paper dust are obviated, but means that such toner and paper dust recycled in a small amount are directly conveyed to the nip between the drum 2 and the sleeve 4A. However, the amount of the deteriorated toner and paper dust to reach the above nip is far smaller than when they accumulate on the guide surface 10A, making the contamination of the background area and the defects of images inconspicuous to the eye.

As stated above, only if the guide surface 10A facing the sleeve 4A is formed of a conductive material, the illustrative embodiment prevents the deteriorated toner and paper dust from depositing on the guide surface 10A without resorting to, e.g., sophisticated bias control for collecting them.

Figure 4:
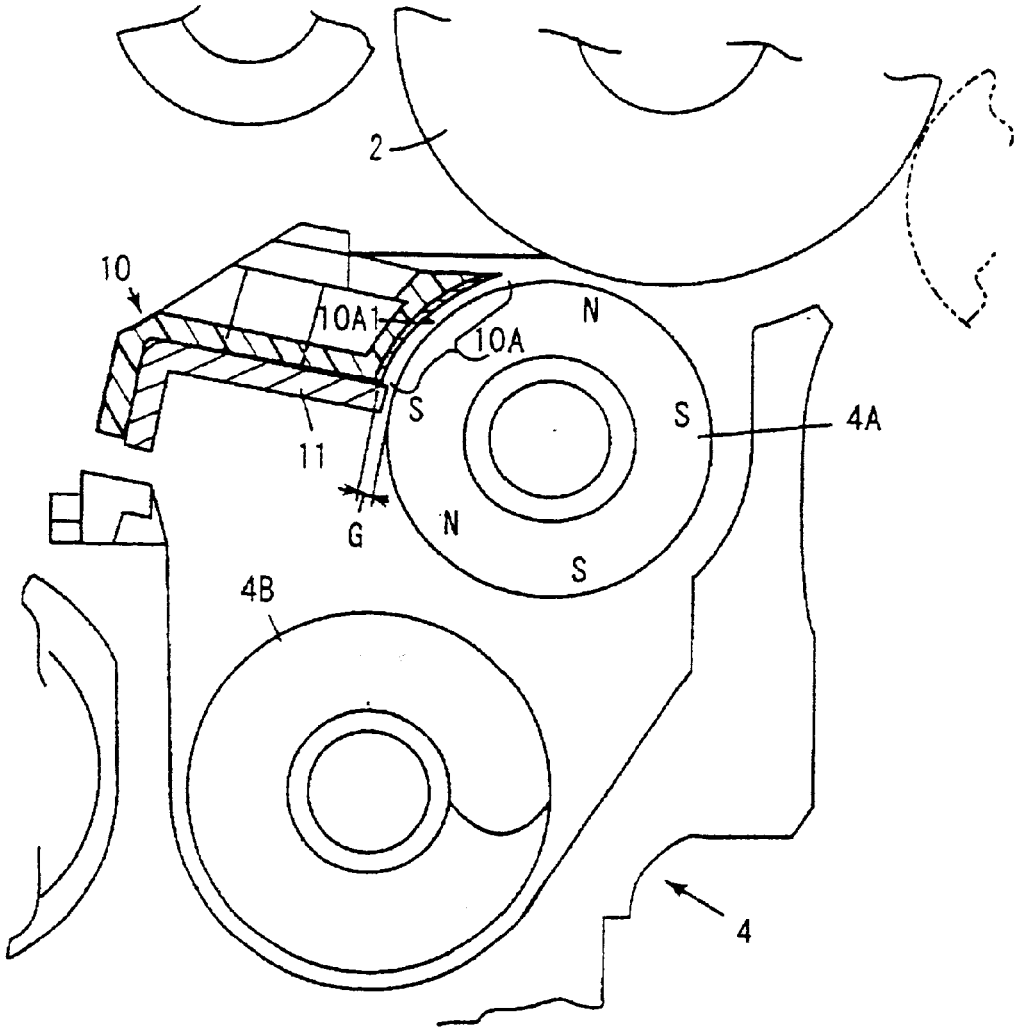
FIG. 4 is a fragmentary view showing an alternative embodiment of the present invention.

An alternative embodiment of the present invention will be described with reference to FIG. 4. In FIG. 4, structural elements identical with the structural elements shown in FIG. 2 are designated by identical reference numerals and will not be described specifically in order to avoid redundancy. As shown, the guide member 10 differs from the guide member of the previous embodiment in that only its guide surface 10A is formed of a conductive member. More specifically, the major portion of the guide member 10 other than the guide surface 10A is implemented as a molding of ABS, AP, PET or similar resin. The surface of the molding expected to constitute the conductive guide surface 10A is formed with a conductive layer 10A1 by plating or metal vapor deposition.

The guide member 10 is constructed integrally with the doctor blade 11 via the engaging portions 10B, FIGS. 3A and 3B, so that conduction is set up between the conductive layer 10A1 and the doctor blade 11, as in the previous embodiment. The conductive layer 10A1 is therefore held in an electrically floating state. It follows that the guide surface 10A is held at the same potential as the doctor blade 11 and/or the sleeve 4A.

With the above configuration, the illustrative embodiment also prevents the deteriorated toner and paper dust contained in the recycled toner from depositing on the guide surface of conductive layer 10A1 for the reasons described previously in relation to the previous embodiment. Another advantage of the illustrative embodiment is that the major portion of the guide member 10 other than the guide surface 10A is implemented as a resin molding and therefore light weight and low cost.

Figure 5:
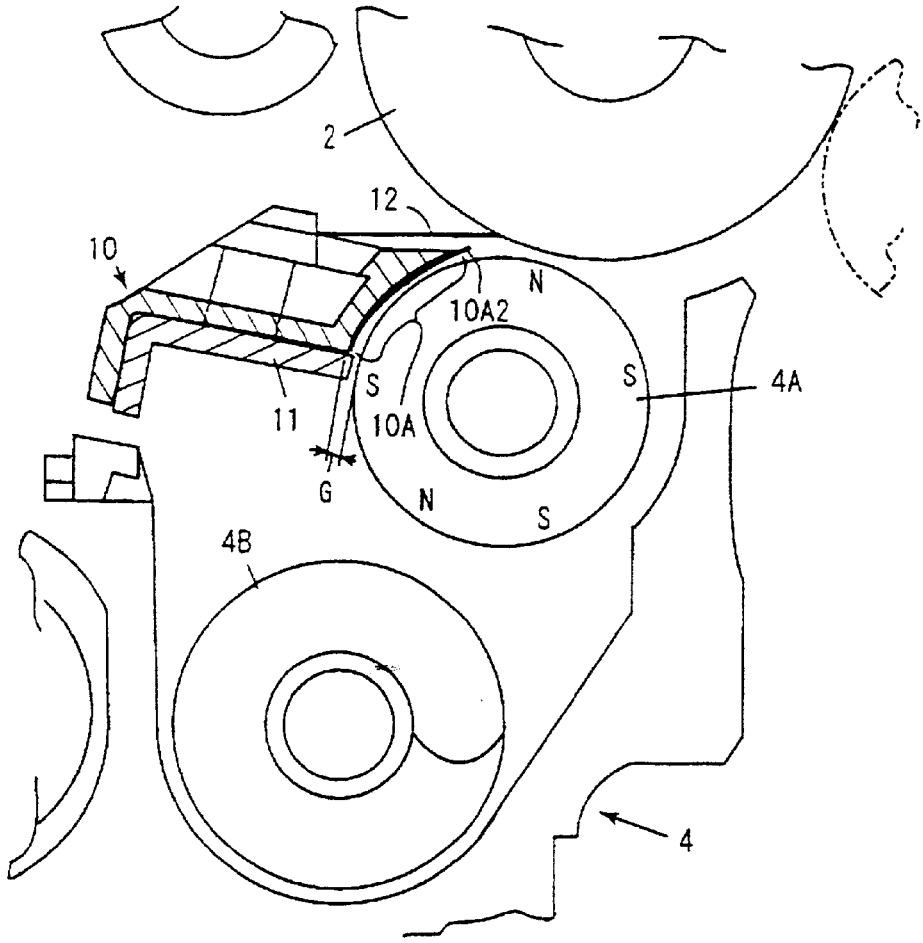
FIG. 5 is a fragmentary view showing another alternative embodiment of the present invention.

Reference will be made to FIG. 5 for describing another alternative embodiment of the present invention. In FIG. 5, structural elements identical with the structural elements shown in FIG. 2 are designated by identical reference numerals and will not be described specifically in order to avoid redundancy. As shown, the guide member 10 has its major portion implemented as a resin molding as in the embodiment of FIG. 4. The different is that in FIG. 5 a conductive member 10A2 different in material from the guide member 10 is adhered to the guide surface 10A in an electrically floating state.

For the conductive member 10A2, use may be made of a tape of copper foil, a Mylar film with aluminum deposited thereon, aluminum foil, a conductive resin film or a cloth implemented by conductive fibers by way of example. The conductive member 10A2 is adhered to the guide surface 10A by use of a two-sided adhesive tape or adhesive. In the illustrative embodiment, a 0.1 mm thick, Mylar film with aluminum deposited thereon is used as the conductive member 10A2. The conductive member 10A2 is also held in a floating state and held at the same potential as the doctor blade 11 and/or the sleeve 4A.

With the above configuration, the illustrative embodiment also prevents the deteriorated toner and paper dust contained in the recycled toner from depositing on the guide surface of conductive layer 10A2 for the reasons described previously in relation to the previous embodiment. In addition, the conductive member 10A2 particular to the illustrative embodiment allows the guide surface 10A to be provided with any desired conduction characteristic, which is optimal for obviating the deposition of impurities.

As shown in FIG. 5, the illustrative embodiment additionally includes a seal member 12 adjoining the nip between the drum 2 and the sleeve 4A. More specifically, the seal member 12 extends above the portion of the gap G adjoining the above nip and the portion of the nip adjoining the guide member 10. One end of the seal member 12 is held in contact with the drum 2. The seal member 12 may be similarly applied to the embodiments stated earlier.

Even when the length and thickness of the conductive member 10A2 adhered to the guide surface 10A are not accurate, the seal member 12 prevents the deteriorated toner and paper dust from reaching the nip between the drum 2 and the sleeve 4A. This obviates defective images more positively than the previous embodiments.

I compared the configuration shown in FIG. 5 and a conventional configuration as to the frequency of defects occurred in the non-image area of the drum 2, i.e., local omission and unexpected image density ascribable to the deteriorated toner and paper dust. For the comparison, I used sheets of the kind producing a relatively great amount of paper dust. FIG. 6 shows the result of comparison. As FIG. 6 indicates, the frequency of defects is far lower in the illustrative embodiment than in the conventional configuration. That is, the illustrative embodiment has a greater margin as to the prevention of defective images than the conventional configuration.

In summary, it will be seen that the present invention provides a developing device and an image forming apparatus capable of protecting an image carrier from defective images ascribable to impurities, which include deteriorated toner and paper dust, without resorting to a filter mechanism or a bias for collection.

Various modifications will become possible for those skilled in the art after receiving the teachings of the present disclosure without departing from the scope thereof.

What is claimed is:

1. A developing device for feeding a developer stored therein to an image carrier, said developing device comprising:

a sleeve facing the image carrier for causing the developer deposited thereon to contact a latent image formed on said image carrier;

a regulating member facing said sleeve for regulating a thickness of the developer that forms a layer on said sleeve;

a guide member having a guide surface for guiding the developer regulated by said regulating member toward a surface of the image carrier, wherein said guide surface has a conductive surface facing said sleeve, and wherein said guide surface of said guide member includes a conductive portion; and a seal member adjoining said conductive portion and covering part of a space where said conductive portion and said sleeve face each other positioned at a side where said sleeve and the image carrier face each other.

2. The developing device as claimed in claim 1, wherein said guide member is formed of a nonmagnetic material.

3. The developing device as claimed in claim 1, wherein said guide surface is shaped complementarily to a surface of said sleeve and spaced from said surface of said sleeve by a gap that allows the developer to pass therethrough.

4. A developing device for feeding a developer stored therein to an image carrier, said developing device comprising:

a sleeve facing the image carrier for causing the developer deposited thereon to contact a latent image formed on said image carrier;

a regulating member facing said sleeve for regulating a thickness of the developer that forms a layer on said sleeve; and a guide member having a guide surface for guiding the developer regulated by said regulating member toward a surface of the image carrier;

wherein said guide surface has a conductive surface facing said sleeve, and wherein said guide surface of said guide member includes a conductive portion different in material from said guide member, said conductive portion completely covering said guide surface.

5. The developing device as claimed in claim 4, wherein said conductive portion different in material from said guide member is adhered to said guide surface.

6. The developing device as claimed in claim 4, wherein said conductive portion is formed on said guide surface by plating or vapor deposition.

7. The developing device as claimed in claim 4, wherein said conductive portion is held in an electrically floating state.

8. The developing device as claimed in claim 4, wherein said conductive portion has a same potential as said regulating member.

9. The developing device as claimed in claim 4, wherein said regulating member comprises a conductive member held in an electrically floating state.

10. The developing device as claimed in claim 4, wherein said conductive portion has a same potential as said sleeve.

11. The developing device as claimed in claim 10, wherein electrical conduction is set up between said conductive portion and said sleeve.

12. The developing device as claimed in claim 4, wherein said conductive portion is held stationary.

13. The developing device as claimed in claim 4, further comprising a seal member adjoining said conductive portion and covering part of a space where said conductive portion and said sleeve face each other positioned at a side where said sleeve and the image carrier face each other.

14. The developing device as claimed in claim 3, wherein said guide surface of said guide member includes a conductive portion different in material from said guide member.

15. The developing device as claimed in claim 1, wherein said conductive portion different in material from said guide member.

16. The developing device as claimed in claim 15, wherein said conductive portion different in material from said guide member is adhered to said guide surface.

17. The developing device as claimed in claim 15, wherein said conductive portion is formed on said guide surface by plating or vapor deposition.

18. The developing device as claimed in claim 15, wherein said conductive portion is held in an electrically floating state.

19. The developing device as claimed in claim 15, wherein said conductive portion has a same potential as said regulating member.

20. The developing device as claimed in claim 19, wherein said regulating member comprises a conductive member held in an electrically floating state.

21. The developing device as claimed in claim 15, wherein said conductive portion has a same potential as said sleeve.

22. The developing device as claimed in claim 21, wherein electrical conduction is set up between said conductive portion and said sleeve.

23. The developing device as claimed in claim 15, wherein said conductive portion is held stationary.

24. In an image forming apparatus including a developing device, said developing device comprising:

a sleeve facing the image carrier for causing a developer deposited thereon to contact a latent image formed on said image carrier;

a regulating member facing said sleeve for regulating a thickness of the developer that forms a layer on said sleeve;

a guide member having a guide surface for guiding the developer regulated by said regulating member toward a surface of the image carrier, wherein said guide surface has a conductive surface facing said sleeve, and wherein said guide surface of said guide member includes a conductive portion; and a seal member adjoining said conductive portion and covering part of a space where said conductive portion and said sleeve face each other positioned at a side where said sleeve and the image carrier face each other.

25. The apparatus as claimed in claim 24, wherein the developer comprises a toner and carrier mixture.

* * * * *